US005514423A

United States Patent [19]

Krish et al.

[11] Patent Number: 5,514,423

[45] Date of Patent: May 7, 1996

[54] ELECTROSTATIC PAINTING METHOD WHEREIN MULTIPLE SPRAY STATIONS HAVING ALTERNATING POLARITIES ARE USED TO MINIMIZE THE RESIDUAL CHARGE ON A PLASTIC SUBSTRATE

[75] Inventors: Vijay Krish, Dearborn; Aris Nikolaidis, Oak Park; Jerry Boeck, Sterling Heights, all of Mich.

[73] Assignee: Ford Motor Company, Dearborn, Mich.

[21] Appl. No.: 270,549

[22] Filed: Jul. 5, 1994

[51] Int. Cl.[6] ..... B05D 1/36

[52] U.S. Cl. ..... 427/470; 427/477; 427/479; 427/483

[58] Field of Search ..... 427/470, 477, 427/479, 483; 118/627, 629, 630, 631, 634; 239/3, 690, 695, 708

[56] References Cited

U.S. PATENT DOCUMENTS

| | | | |
|---|---|---|---|
| 2,794,751 | 6/1957 | Juvinall | 117/93 |
| 3,323,934 | 6/1967 | Point | 239/695 |
| 4,336,275 | 6/1982 | Scholes | 427/27 |
| 4,343,828 | 8/1982 | Smead et al. | 427/27 |
| 4,377,603 | 3/1983 | Itoh et al. | 427/25 |
| 4,703,891 | 11/1987 | Jackson et al. | 239/171 |
| 5,222,663 | 6/1993 | Noakes et al. | 239/3 |

*Primary Examiner*—Shrive Beck
*Assistant Examiner*—David M. Maiorana
*Attorney, Agent, or Firm*—D. Porcari; R. L. May

[57] ABSTRACT

A method and apparatus for electrostatically coating a non-conductive article. The article is passed through multiple stations where electrostatically charged liquid coatings are applied to the article. Adjacent stations have opposite polarity and neutralize the residual electric charge buildup from the preceding station.

1 Claim, 2 Drawing Sheets

ELECTROSTATIC PAINTING METHOD WHEREIN MULTIPLE SPRAY STATIONS HAVING ALTERNATING POLARITIES ARE USED TO MINIMIZE THE RESIDUAL CHARGE ON A PLASTIC SUBSTRATE

BACKGROUND OF THE INVENTION

1. Field of the Invention

The present invention relates to a method of electrostatically coating a non-conductive article. More specifically, the invention relates to a method and device for electrostatically painting plastic articles.

2. Description of the Related Art

Electrostatic painting has widely been used to paint conductive articles such as steel automobile bodies. Small droplets of paint are electrostatically charged and sprayed onto the metal surface. The metal surface is grounded and the charged paint droplets are attracted to the metal surface. Electrostatic painting reduces the amount of overspray and promotes the adhesion of the paint to the metal surface. Various methods of electrostatically painting non-conductive articles have been tried. Foremost among these methods is an attempt to electrically ground the article by attaching metal grounding wires to the plastic article to discharge the electric potential buildup on the surface of the article. It is difficult and time-consuming to ground plastic parts using metal wires.

The electrostatic painting process deposits a layer of electrostatically charged paint droplets atop a surface. If the surface is completely grounded, as in the case of metal articles, the electrostatic charge dissipates through the article into the ground. If the surface is non-conductive or improperly grounded, then areas of residual electrostatic charge remain atop the surface of the article. This residual electrostatic charge repels subsequent application of electrostatic paint having the same polarity. The resulting finish has a non-uniform paint thickness and poor surface appearance.

The problem of charge build-up was addressed in U.S. Pat. No. 5,222,663, issued to Noakes, et al., Jun. 29, 1993. Noakes, et al. teaches that electric charge tends to accumulate if an attempt is made to coat a plastic article with electrically charged particles. The accumulated charge tends to repel subsequent spray clouds of charged particles (see Column 4, Lines 33–39). Noakes et al. attempts to overcome this charge buildup by applying an alternating potential for electrostatically charging the paint. The paint separates into discrete ligaments, each having an opposing polarity. The frequency of the alternating electric potential is such that each cloud ligament of atomized particles is deposited onto the plastic's surface without discharging any particles from the preceding cloud. The spray clouds substantially neutralize each other on the target. Noakes et al. applies a pulsed stream of paint clouds. Physical separation of the oppositely charged paint clouds is necessary to avoid residual charge build-up.

The device taught by Noakes et al. is useful only with single sprayer applications. Multiple sprayers would cause interfering spray patterns whereby the electric charge of spray droplets would be discharged in the air above the target surface. Complex three dimensional parts often require two or more sprayers to completely coat the surface of the article. Additionally, small variations in the electronic signal applied to the sprayer causes fluctuations in the cloud ligament size and resulting paint finish. The complexities of the electronic components and the finish produced from a pulse spray discourage the use of this device.

Oppositely charged sprayers having the same electric potential have been used to aid in the atomization of liquid pesticides when sprayed from an airplane. U.S. Pat. No. 4,703,891, issued to Jackson et al., Nov. 3, 1987, teaches a device having two banks of sprayers. Each bank has multiple sprayers connected to an electric generator applying the same polarity to each sprayer within a bank. The banks apply electric fields having opposite polarities to prevent or reduce the static buildup on the sprayers. Excess electric potential is dissipated through the liquid droplets and each bank of sprayers maintains an approximately balanced electric charge.

The Jackson et al. device is intended to aid in the atomization of the liquid pesticide. Airplanes are necessarily ungrounded and susceptible to electric potential buildup on the spray heads. The electric potential buildup reduces the atomization of the liquid pesticide and, hence, the efficiency of the sprayers. To avoid charge buildup, the atomized mist forms an electrical circuit between the generators. Each bank of sprayers produces oppositely charged spray droplets. The droplets are intentionally intermingled to balance the electric potential of the mist. This balancing negates the resulting electric potential on each spray droplet and renders it unsuitable for use in a paint application process. Individual paint droplets would not have an electrostatic charge when they strike the surface of the article to be painted.

It is useful to provide a method and device for applying electrostatically charged paint droplets to a non-conductive surface whereby residual electrostatic potential on the painted surface does not repel subsequent paint applications. The device should permit multiple sprayers to apply a uniform layer of paint atop a complex three dimensional surface.

SUMMARY OF THE INVENTION

The present invention relates to a method of electrostatically coating a non-conductive article using sequential applications of the coating. An electrostatic charge having a first potential and a first polarity is applied to a first coating liquid spray. The coating liquid is sprayed atop the article and the article is moved to a second station. An electrostatic charge having a second potential and a second polarity is applied to the liquid spray. The second polarity is opposite from the first polarity. The surface of the article becomes approximately electrically neutral. Maintaining opposing polarities between adjacent coating stations reduces the residual electric charge buildup on the coated article. Any small residual electric charge serves to attract oppositely charged paint droplets from the next station.

The invention permits the use of multiple sprayers having the same electric potential within a station and reduces the importance of grounding the entire surface of a non-conductive article. The sprayers produce a uniform paint spray and a paint spray booth using the invention may be constructed or adapted from existing readily available commercial components.

DETAILED DESCRIPTION OF THE PREFERRED EMBODIMENTS

Figure 1:
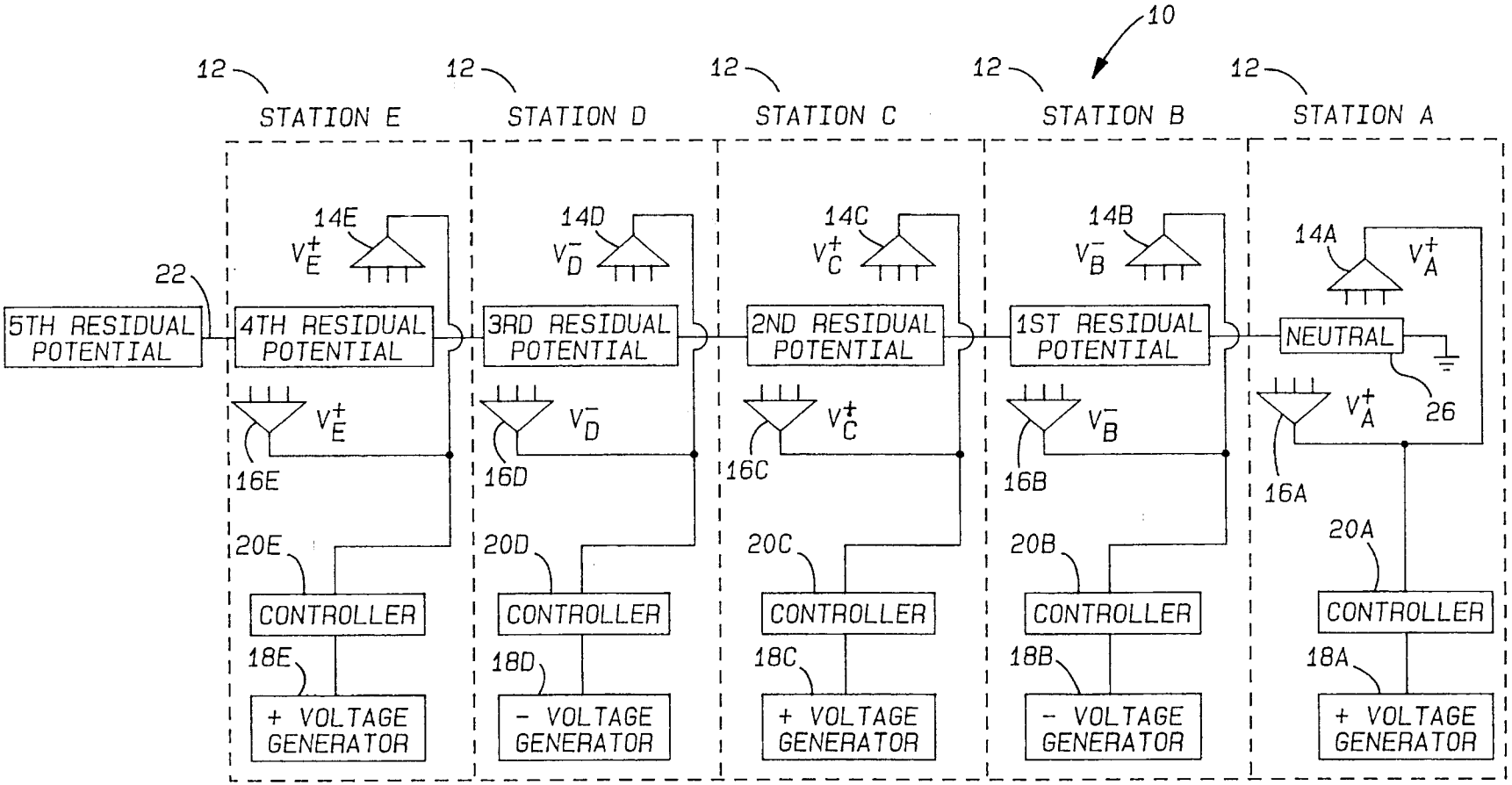
FIG. 1 is a schematic representation of a paint spray booth.

Illustrated in FIG. 1 is a schematic diagram of paint spray booth 10. Booth 10 comprises five individual spraying stations 12A–E. Each station applies a layer of paint having a polarity opposite from its adjoining stations. Each station contains one or more sprayers. For example, station 12A includes sprayers 14A and 16A. Sprayers 14A–E,16A–E spray a mist of electrically charged paint droplets. Each station contains a voltage generator and controller. Voltage generators 18A–18E produce an electric potential which imparts an electrostatic charge to the paint droplets. Controllers 20A–20E regulate the electric potential applied to sprayers 14A–E,16A–E as shown.

A moving conveyor 22 passes through station 12A–12E. Conveyor 22 is electrically grounded and carries an article receiving paint from sprayers 14A–E,16A–E. An article travelling through booth 10 receives paint from each station 12A–E.

Figure 2:
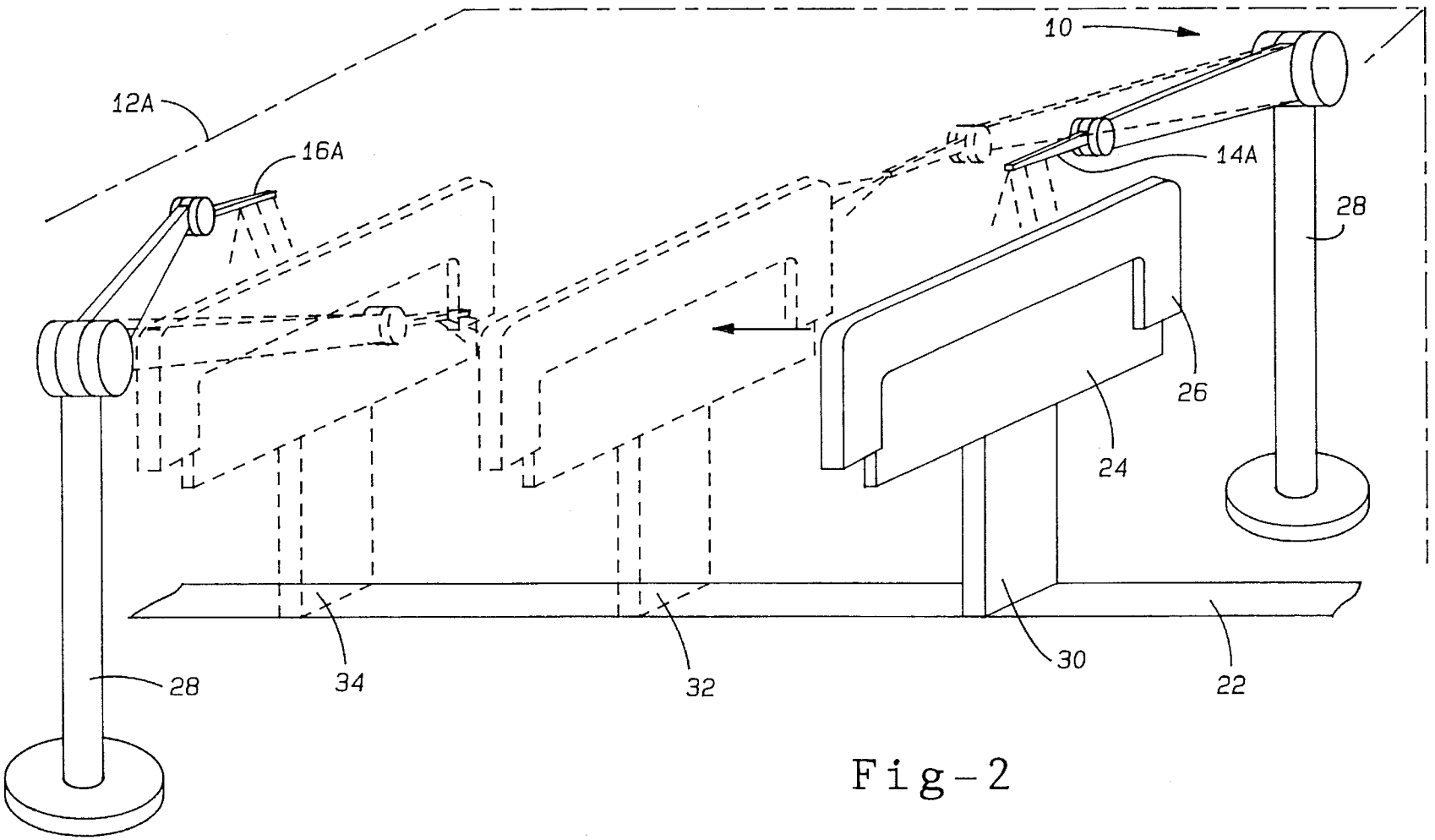
FIG. 2 is a perspective view of a single station of a multiple station spray booth.

Illustrated in FIG. 2 is a perspective view of spray station 12A. Stations 12B–12E are of similar construction and are immediately adjacent station 12A. Conveyor 22 transports carrier 24 through booth 10. Carrier 24 is electrically grounded and shaped to receive article 26. For purposes of illustration, article 26 is shown as a bumper facia. Article 26 has three painted surfaces generally requiring paint application from two directions. Conveyor 22 moves article 26 through booth 12A at a predetermined uniform rate. When article 26 is located at position 30, it receives electrostatically charged paint from sprayer 14A. Sprayer 14A is attached to robotically controlled spray arm 28. Arm 28 has three degrees of freedom and permits sprayer 14A to reach at least two surfaces of article 26. Sprayer 14A continuously applies paint to article 26 as it moves to position 32. At position 32, article 26 begins to receive paint from sprayer 16A. Sprayer 16A is also positioned on a robotically controlled spray arm 28. At position 32, article 26 receives paint from both sprayer 14A and 16A. At least a portion of paint spray from sprayers 14A,16A overlap and mix. Paint emitted from sprayers 14A and 16A has the same electric potential and polarity and, therefore, does not become neutralized in the air above article 26. As article 26 continues to move to position 34, it receives paint only from sprayer 16A.

Method of Operation

The construction of spray booth 10 is similar to those currently in use. Current spray booths use multiple sprayers stations all having the same polarity or potential. In a conventional spray booth, the first spray station would apply paint having an electrostatic charge. A typical electrostatic potential would be 85 KV. Approximately 15–20 KV of electrostatic charge would remain on the surface of article 26. Portions of article 26 that are in good intimate contact with carrier 24 display a smaller residual charge and areas having poor intimate contact with carrier 24 display a higher residual charge. The residual charge atop article 26 would tend to repel the charged paint droplets having the same polarity from the next station. Because the residual charge is non-uniform along the article surface, it tends to result in a non-uniform paint appearance. It is not always possible to increase the electric potential of the second station. Higher electric potentials cause wear on the sprayers and may potentially cause a breakdown in the paint or arcing between the sprayer and ground.

The present invention alleviates this problem by alternating the polarity between adjacent spray stations. As shown in FIG. 1, article 26 enters station 12A having an approximately neutral electrostatic residual charge. Paint from sprayers 14A,16A spray a mist of electrostatically charged paint droplets having a charge of +85 KV. The paint droplets strike the neutral surface of article 26. Depending on the conductivity and grounding methods used, article 26 has an approximately +15 KV residual charge after passing through station 12A. Station 12B sprays paint with a polarity opposite that of station 12A. Voltage generator 18B produces negatively charged paint droplets. Controller 20B produces a potential which is approximately the difference between the residual potential on article 26 after receiving paint from station A and the electrostatic potential applied at sprayers 14A,16A. In the present example, controller 20B provides a −70 KV electrostatic charge to the spray droplets. Paint from sprayers 14B,16B is attracted to the +15 KV residual electric charge on the surface of article 26. The surface of article 26 becomes approximately neutral after exiting station 12B.

This process is repeated in stations 12C–12E. Each subsequent station attempts to minimize the residual electric charge on article 26 and maintain an ideal electric potential difference between the sprayer and article. Paint transfer efficiencies are significantly improved. Less paint is needed to paint an article and overspray is reduced. In addition to paint savings, there are also manufacturing savings. Less waste paint needs to be treated and recycled and spray booths need fewer cleanings. The invention permits the use of lower electrostatic potentials. These lower potentials reduce the chance of arcing or paint breakdown.

Electrostatic charge monitors (not shown) may be added to measure the residual electrostatic charge on article 26. Controllers 20A–20E may be automatically regulated to apply an electrostatic charge sufficient to neutralize the residual electric charge on article 26 from the previous station. The monitor would be located before each paint station.

The actual voltage applied to the sprayers 14A–E, 16A–E varies based on the part to be painted, the type of paint and the construction of the sprayer. Commercial automotive electrostatic paint sprayers operate below 90 KV to reduce wear. For maximum paint transfer efficiency, the optimum charge potential between the sprayer and the article may be higher than 90 KV. In an alternative embodiment of the invention, station 12B may be tuned to apply −85 KV. Assuming article 26 retains a +15 KV charge from station 12A, there is created a 105 KV difference between sprayer 14B, 16B and article 26. This 105 KV potential is below the arcing potential of the paint but higher than the potential of the sprayer alone. Article 26 exits station 12B with an approximate −15 KV charge. This may be then repeated in stations 12C–E. This permits even greater paint transfer efficiencies than possible with a neutral surface. The electrostatic attraction between the paint and the article exceeds that of the sprayer. This permits the use of lower cost equipment and increased equipment life.

The invention is primarily intended for applying the same paint at stations 12A–12E. Different paint or other coating material may be applied in these stations. The invention is useful in the application of multiple layers of liquid coatings having an electrostatic charge. The invention has the ancillary benefit of reducing the attraction of airborne particles to the freshly painted surface. Other variations and modifications to the present invention may be made without departing from the scope of the following claims.

We claim:

1. A method of electrostatically painting a moving plastic article comprising the steps of:

spraying said article with a first mist of electrostatically charged paint having a first potential, whereby said article becomes at least partially charged with a first residual potential having a first polarity;

moving said article to a second area and spraying said article with a second mist of electrostatically charged paint having a second potential opposite in polarity from said first polarity, said second potential approximately equal to the difference between said first residual potential and said first potential, whereby said article becomes at least partially charged with a second residual potential which is approximately neutral.

* * * * *